US007458242B2

(12) United States Patent
Rataj et al.

(10) Patent No.: US 7,458,242 B2
(45) Date of Patent: Dec. 2, 2008

(54) APPARATUS AND METHOD FOR MANUFACTURING A ROCK BOLT

(75) Inventors: Mieczyslaw S. Rataj, Charlestown (AU); Alan Henderson, Dalmeny (CA); Albert Taylor, Saskatoon (CA)

(73) Assignee: Dywidag-Systems International Pty Limited, Bennett's Green (AU)

( * ) Notice: Subject to any disclaimer, the term of this patent is extended or adjusted under 35 U.S.C. 154(b) by 184 days.

(21) Appl. No.: 11/220,254

(22) Filed: Sep. 6, 2005

(65) Prior Publication Data

US 2006/0054748 A1 Mar. 16, 2006

(30) Foreign Application Priority Data

Sep. 13, 2004 (AU) ..... 2004905253

(51) Int. Cl.

| | |
|---|---|
| ***B21B 15/02*** | (2006.01) |
| ***B21D 11/00*** | (2006.01) |
| ***B21D 11/14*** | (2006.01) |
| ***B21F 7/00*** | (2006.01) |

(52) U.S. Cl. ..... 72/65; 72/64; 72/306; 72/307; 72/311; 72/371; 140/149

(58) Field of Classification Search ..... 140/149, 140/105, 36, 39, 118–119; 72/64, 65, 298, 72/305–307, 299, 311, 371, 318, 377, 308
See application file for complete search history.

(56) References Cited

U.S. PATENT DOCUMENTS

| | | | | |
|---|---|---|---|---|
| 2,723,702 | A * | 11/1955 | Wyss | 72/299 |
| 3,357,205 | A * | 12/1967 | Holtkamp | 464/179 |
| 3,540,100 | A | 11/1970 | Carriere | |
| 3,559,275 | A | 2/1971 | Slater | |
| 3,750,720 | A * | 8/1973 | Steigerwald | 140/149 |
| 4,150,473 | A | 4/1979 | Dietrich | |
| 4,237,942 | A | 12/1980 | Dietrich | |
| 4,469,756 | A | 9/1984 | Jungworth et al. | |
| 4,773,247 | A | 9/1988 | Zols | |
| 4,790,129 | A | 12/1988 | Hutchins | |
| 5,344,256 | A | 9/1994 | Hedrick | |
| 5,676,013 | A * | 10/1997 | Kahlau | 72/299 |
| 5,771,726 | A * | 6/1998 | Bibby et al. | 72/20.2 |
| 5,904,059 | A * | 5/1999 | Perna | 72/79 |
| 6,434,995 | B1 * | 8/2002 | Kataoka et al. | 72/307 |
| 6,820,657 | B1 | 11/2004 | Hedrick | |

FOREIGN PATENT DOCUMENTS

| | | |
|---|---|---|
| CA | 1059351 | 7/1979 |

(Continued)

*Primary Examiner*—Derris H. Banks
*Assistant Examiner*—Teresa Bonk
(74) *Attorney, Agent, or Firm*—Marshall, Gerstein & Borun LLP

(57) ABSTRACT

An apparatus for manufacturing a cable bolt from a cable (1) includes first and second clamps (2, 3) adapted to releasably clamp the cable (1) with the cable (1) extending along the longitudinal axis (4) of the apparatus. A first cable displacement device (12) longitudinally displaces the first clamp (2) relative to the second clamp (3) along the longitudinal axis (4). A first clamp rotation device (14) rotates the first clamp (2) relative to the second clamp (3) about the longitudinal axis (4). The apparatus also has a second clamp displacement device (19) for simultaneously longitudinally displacing the first and second clamps (2, 3) along the longitudinal axis (4).

16 Claims, 3 Drawing Sheets

FOREIGN PATENT DOCUMENTS

| | | |
|---|---|---|
| FR | 1546511 | 11/1968 |
| FR | 2378123 | 8/1978 |
| GB | 975642 | 11/1964 |
| GB | 1024696 | 3/1966 |
| GB | 2144784 | 3/1985 |
| GB | 2265394 | 9/1993 |

* cited by examiner

APPARATUS AND METHOD FOR MANUFACTURING A ROCK BOLT

FIELD OF THE INVENTION

The present invention relates to mining and ground excavation, and in particular relates to an apparatus and method for forming a cable bolt form of rock bolt for securing the roof or wall of a mine, tunnel or other ground excavation.

BACKGROUND OF THE INVENTION

Rock bolts are utilised to secure the roof or walls of an underground mine, tunnel or other ground excavation by inserting the rock bolt into a bore hole drilled in the face of the rock to be secured and securing the rock bolt within the hole. One known form of rock bolt is a cable bolt (sometimes called a strand bolt) that includes a plurality of helically wires wound into the form of a cable.

In one known cable bolt installation method, grout is injected into the bore hole after insertion of the cable bolt so as to encapsulate at least part of the length of the cable, securing the cable bolt within the bore hole once the grout has set. A rock face plate is attached to the exposed end of the cable bolt and arranged to bear against the rock face to thereby apply a compressive load against the rock face, stabilizing the same. In order to increase the bond strength between the cable bolt and the grout encapsulating the cable bolt, it is known to form one or more bulbous portions in the cable bolt, thereby locally increasing the cross sectional area of the cable bolt, acting to resist pulling of the cable bolt through the grout.

In one previously proposed technique of forming bulbous portions along the length of a cable bolt, as described in Australian Patent No. 640,906, a pair of longitudinally spaced clamps are arranged to releasably clamp a cable, with one of the clamps being longitudinally displaceable in relation to the fixed clamp by way of an hydraulic ram. In operation, the cable is clamped with the two clamps in a spaced apart relationship, with the displaceable clamp then being displaced toward the fixed clamp, thereby buckling the wires of the cable between the clamps, resulting in the formation of a bulbous portion in the cable bolt.

Given the strength of the wires forming the cable bolt, and the fact that they are supported against buckling by virtue of the tightly wound arrangement of the wires of the cable bolt, large compressive loads are required to initiate the buckling. As a result, large clamping loads are required to prevent slippage of the clamp jaws on the cable. This necessitates powerful rams to drive the clamps.

The displaceable clamp is also utilized to advance the cable bolt after having formed a bulbous portion in preparation for forming a further bulbous portion further along the cable. The cable is advanced through a sequence of unclamping the clamps after forming the first bulbous portion, retracting the displaceable clamp, reclamping the cable bolt with the displaceable clamp and subsequently advancing the displaceable clamp toward the fixed clamp. As a result of this post-bulbous portion formation sequence being required to advance the cable, production is relatively slow.

OBJECT OF THE INVENTION

It is the object of the present invention to overcome or at least substantially ameliorate at least one of the above disadvantages.

SUMMARY OF THE INVENTION

There is disclosed herein an apparatus for manufacturing a cable bolt from a cable, said apparatus having a longitudinal axis and comprising:

a first clamp adapted to releasably clamp the cable with the cable extending along said longitudinal axis;

a second clamp adapted to releasably clamp the cable with the cable extending along said longitudinal axis;

a first clamp displacement device for longitudinally displacing said first clamp, relative to said second clamp, along said longitudinal axis; and a first clamp rotation device for rotating said first clamp, relative to said second clamp, about said longitudinal axis;

wherein said first clamp rotation device is adapted to rotate said first clamp relative to said second clamp simultaneously with longitudinal displacement of said first clamp relative to said second clamp.

In one form, said first clamp rotation device comprises a cam mechanism.

Preferably, said cam mechanism comprises:

a first cylinder concentrically mounted with respect to said longitudinal axis and being rotationally fixed in relation to said first clamp, said first cylinder having an aperture extending longitudinally therethrough for receipt of the cable extending along said longitudinal axis, and a second cylinder concentrically mounted about said first cylinder, wherein one of said first and second cylinders is provided with a cam slot extending at an acute angle to said longitudinal axis, with the other of said first and second cylinders being provided with a cam follower engaging said cam slot.

Typically, said first clamp displacement device comprises a first hydraulic ram.

In one form, said apparatus further comprises a second clamp displacement device for simultaneously longitudinally displacing said first clamp and said second clamp along said longitudinal axis.

The apparatus may further comprise a carriage, said first and second clamps being mounted on said carriage, with said second clamp displacement device being adapted to longitudinally displace said carriage along said longitudinal axis.

The first clamp displacement device and said first clamp rotation device may be mounted on said carriage.

The second clamp displacement device may comprise a second hydraulic ram.

Alternatively, the apparatus may further comprise a drive wheel for engaging and advancing the cable along said longitudinal axis.

The drive wheel may be provided with radially extending spikes for engaging the cable.

There is further disclosed herein a method for manufacturing a cable bolt from a cable, said method comprising the steps of:

(a) clamping a first portion of said cable with a first clamp;

(b) clamping a second portion of said cable with a second clamp, said second portion of said cable being spaced from said first portion of said cable along a longitudinal axis of said cable;

(c) rotating said first clamp, relative to said second clamp, about said longitudinal axis in a direction against the lay of said cable;

(d) longitudinally displacing said first clamp, relative to said second clamp, along said longitudinal axis towards said second clamp; and (e) unclamping said first and second portions of said cable;

wherein steps (c) and (d) are carried out simultaneously.

The method may further comprise the step of:

(f) advancing said cable along said longitudinal axis.

In one form, step (f) may be carried out by simultaneously displacing said first and second clamps along said longitudinal axis in a forward direction, steps (f) and (d) being carried out simultaneously.

The method may still further comprise the step of:

(g) simultaneously displacing said first and second clamps along said longitudinal axis in a reverse direction, wherein step (g) is carried out after step (e).

Steps (a) to (g) may be repeated, clamping third and fourth portions of said cable, said third and fourth portions of said cable being longitudinally spaced from said first and second portions of said cable.

Alternatively, step (f) may be carried out by a drive wheel engaging said cable, step (f) being carried out after step (e).

There is still further disclosed herein an apparatus for manufacturing a cable bolt from a cable, said apparatus having a longitudinal axis and comprising:

a first clamp adapted to releasably clamp the cable with the cable extending along said longitudinal axis;

a second clamp adapted to releasably clamp the cable with the cable extending along said longitudinal axis;

a first clamp displacement device for displacing said first clamp in relation to said second clamp, along said longitudinal axis; and a second clamp displacement device for simultaneously longitudinally displacing said first and second clamps along said longitudinal axis.

The apparatus may further comprise a carriage, said first and second clamps being mounted on said carriage, with said second clamp displacement device being adapted to longitudinally displace said carriage along said longitudinal axis.

The first clamp displacement device may be mounted on said carriage.

Typically, said first clamp displacement device comprises a first hydraulic ram.

Typically, said second clamp displacement device comprises a second hydraulic ram.

There is further disclosed herein a method for manufacturing a cable bolt from a cable, said method comprising the steps of:

(a) clamping a first portion of said cable with a first clamp;

(b) clamping a second portion of said cable with a second clamp, said second portion of said cable being spaced from said first portion of said cable along a longitudinal axis of said cable;

(c) longitudinally displacing said first clamp, relative to said second clamp, along said longitudinal axis towards said second clamp;

(d) simultaneously displacing said first and second clamps along said longitudinal axis in a forward direction; step (d) being carried out simultaneously with step (c); and (e) unclamping said first and second portions of said cable.

The method may further comprise the step of:

(f) simultaneously displacing said first and second clamps along said longitudinal axis in a reverse direction, wherein step (f) is carried out after step (e).

Steps (a) to (f) may be repeated, clamping third and fourth portions of said cable, said third and fourth portions of said cable being longitudinally spaced from said first and second portions of said cable.

BRIEF DESCRIPTION OF THE DRAWINGS

Preferred forms of the present invention will now be described by way of example with reference to the accompanying drawings, wherein.

DETAILED DESCRIPTION OF THE PREFERRED EMBODIMENTS

Figure 1:
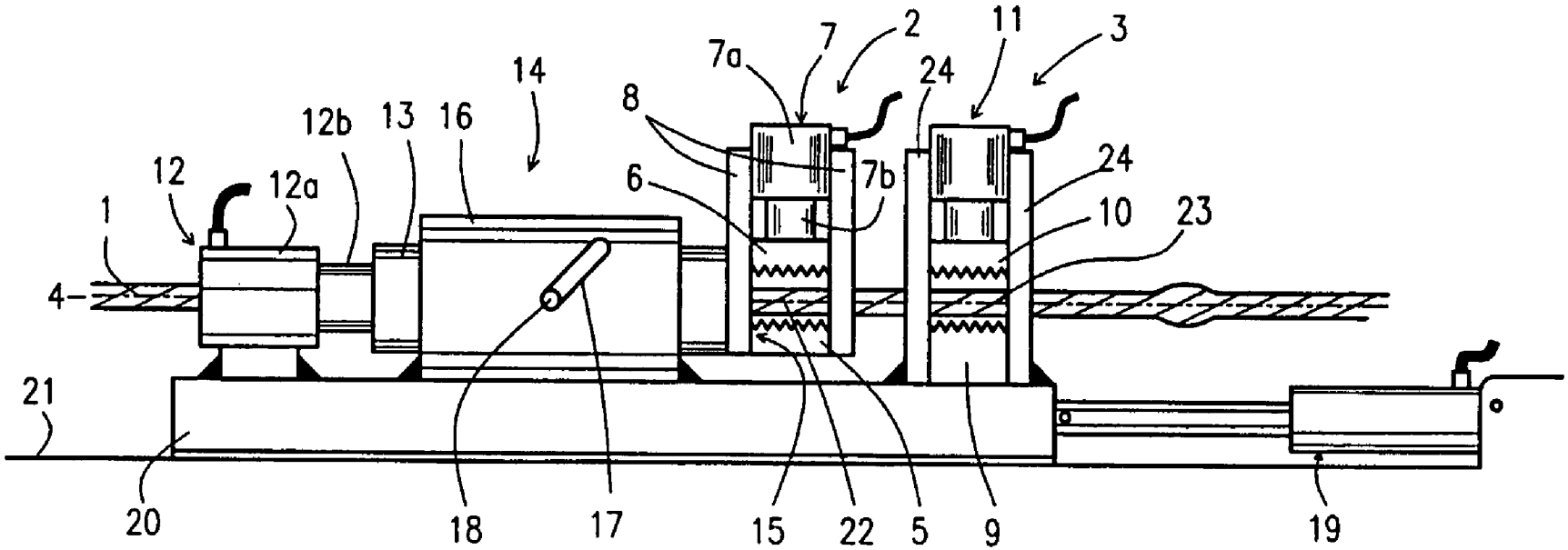
FIG. 1 is a side elevation view of an apparatus for manufacturing a cable bolt prior to formation of a bulbous portion.
Figure 2:
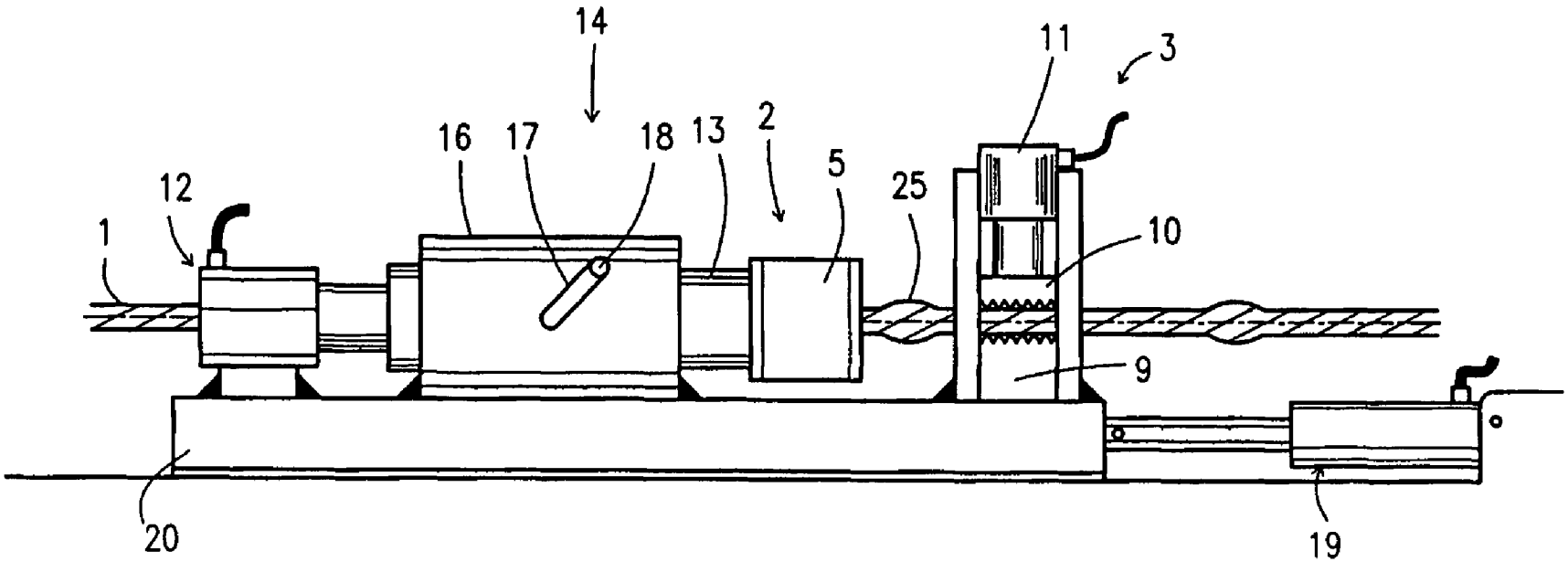
FIG. 2 is a side elevation view of the apparatus of FIG. 1 after formation of a bulbous portion.

Referring to FIGS. 1 and 2 of the accompanying drawings, an apparatus for manufacturing a cable bolt from a cable 1 includes first and second clamps 2, 3 adapted to releasably clamp the cable 1 with the cable extending along a longitudinal axis 4 of the apparatus.

The first clamp 2 comprises lower and upper clamp jaws 5, 6, having serrated teeth for gripping the cable 1, and a first hydraulic clamping ram 7 attached to the first clamp upper jaw 6 for driving the first clamp upper jaw 6 into engagement with the cable 1, thereby clamping the cable 1 between the first clamp upper and lower jaws 5, 6. First clamp guides 8 maintain alignment of the first clamp lower and upper jaws 5, 6 and fix the first ram body 7*a* in relation to the first ram lower jaw 5.

The second clamp 3 is similarly comprised of a second clamp lower jaw 9, a second clamp upper jaw 10, a second hydraulic clamping ram 11 and second clamp guides 24.

The first clamp 2 is longitudinally displaceable relative to the second clamp 3 along the longitudinal axis 4 by way of a first clamp displacement device, here in the form of a first hydraulic ram 12. The plunger 12*b* of the first hydraulic ram 12 is attached to the first clamp lower jaw 5 by way of a first cylinder 13, the primary purpose of which will be discussed below. Extending the first hydraulic ram plunger 12*b* displaces the first clamp 2 towards the second clamp 3 (to the position depicted in FIG. 2), whilst retraction of the first hydraulic ram plunger 12*b* displaces the first clamp 2 away from the second clamp 3 (to the position depicted in FIG. 1). Rather than providing the relative displacement of the first clamp 2 relative to the second clamp 3 by displacing the second clamp 2 alone, it is envisaged that the second clamp 3 may be displaceable and the first clamp 2 fixed, or alternatively that both the first and second clamps 2, 3 be displaceable toward and away from each other.

The first clamp 2 is rotatable, relative to the second clamp 3, about the longitudinal axis 4 by way of a first clamp rotation device. The first clamp rotation device here comprises a cam mechanism 14. The cam mechanism 14 includes the first cylinder 13, which is concentrically mounted with respect to the longitudinal axis 4. The first cylinder 13 is rotationally fixed in relation to the first clamp 2 by way of the first clamp lower jaw 5 being attached to the end of the first cylinder 13. The first cylinder 13 has an aperture 15 extending longitudinally therethrough for receipt of the cable 1. The cam mechanism 14 further includes a second cylinder 16 concentrically mounted about the first cylinder 13. The second (outer) cylinder 16 is provided with a cam slot 17 extending at an acute angle to the longitudinal axis 4. The first (inner) cylinder 13 is provided with a corresponding cam follower 18 engaging the cam slot 17. Here the cam follower 18 is in the form of a pin attached to the outer wall of the inner cylinder 13. In an alternate form, the cam slot 17 could be formed on the inner cylinder 13 with the cam follower 18 provided on the outer cylinder 16.

The cam mechanism 14 provides for simultaneous rotation of the first clamp 2 relative to the second clamp 3 with longitudinal displacement of the first clamp 2 relative to the second clamp 3. Accordingly, extension or retraction of the first hydraulic ram 12 results in relative rotation of the first clamp 2 relative to the second clamp 3 in addition to the relative longitudinal displacement of the first clamp 2. It is envisaged, however, that the first clamp rotation device 14 may be configured to act separately from the first clamp displacement device 12 so as to rotate the first clamp 2 at the same time as it is longitudinally displaced.

The apparatus further comprises a second clamp displacement device, here in the form of a second hydraulic ram 19. The second hydraulic ram 19 acts to simultaneously longitudinally displace the first and second clamps 2, 3 along the longitudinal axis 4. The second hydraulic ram 19 acts directly on a carriage 20 arranged to be longitudinally slidably displaceable on a base 21. The first and second clamps 2, 3 are mounted on the carriage 20 such that extension or retraction of the second hydraulic ram 19 acts to displace both the first and second clamps 2, 3. The first hydraulic ram 12 is also mounted on the carriage by virtue of the first hydraulic ram body 12*a*. Further, the outer cylinder 16 of the first clamp rotation device 14 is also mounted directly on the carriage 20, thereby indirectly providing the mounting of the first clamp 2 on the carriage 20. The second clamp 3 is mounted directly to the carriage 20 by way of the second clamp lower jaw 9.

The operation of the apparatus to manufacture a cable bolt by forming a bulbous portion 24 in the cable 1 will now be described.

Firstly, the apparatus is arranged with a cable 1 extending along the longitudinal axis 4 and passing through the first hydraulic ram 12, the aperture 15 provided in the inner cylinder 13, and between the upper and lower jaws of the first and second clamps 2, 3.

The hydraulic clamping rams 7, 11 are in a retracted state such that the first and second clamps 2, 3 are open. The first hydraulic ram 12 is in a retracted state such that the first and second clamps 2, 3 are in their spaced apart relationship. The second hydraulic ram 19 is in an extended state such that the carriage 20 is positioned to the left as depicted in FIG. 1.

The first and second clamps 2, 3 then clamp first and second portions 22, 23 of the cable 1 by extension of the first and second clamping rams 7, 11.

The first clamp 2 is next longitudinally displaced, relative to the second clamp 3, along the longitudinal axis by extending the first hydraulic ram 12. As the first hydraulic ram 12 is extended, the inner cylinder 13 is displaced through the outer cylinder 16, driving the cam follower 18 along the cam slot 17, thereby rotating the inner cylinder 13. Rotation of the inner cylinder 13 results in rotation of the first clamp 2 relative to the second clamp 3 by virtue of attachment of the first clamp lower jaw 5 (and first clamp guides 8) to the inner cylinder 13. The cam slot 17 is arranged such that the inner cylinder 13 and first clamp 2 are rotated in a direction against the lay of the wires of the cable 1.

The longitudinal and rotational displacement of the first clamp 2 relative to the second clamp 3 partially unwinds or "opens" the wires of the cable positioned between the clamped first and second portions 22, 23 and buckles the wires so as to form a bulbous portion 25. With the wires being unwound as the cable is compressed between the clamps 2, 3, the compressive load required to buckle the wires of the cable 1 is greatly reduced and, accordingly, a much lower clamping force is required to be applied to the first and second clamps 2, 3 to prevent slippage of the clamps 2, 3. Accordingly, smaller clamping rams 7, 11 are able to be employed and the serrated teeth of the jaws of the clamps 2, 3 are subjected to much less wear and accordingly reduced chance of slippage of the cable within the jaws.

The second hydraulic ram 19 is extended simultaneously with retraction of the first hydraulic ram 12, such that the carriage 20, first and second clamps 2, 3 and accordingly the cable 1 are advanced (to the right as depicted in FIG. 2) during the bulb formation process. Accordingly, with activation of both the first and second rams 12, 19 simultaneously, both the first and second clamps 2, 3 advance to the right, with the first clamp 2 advancing to the right at a greater rate than the second clamp 3 as a result of the relative displacement provided by the first hydraulic ram 12.

Upon completion of the extension of the first hydraulic ram 12 and retraction of the second hydraulic ram 19, the first and second cable portions 22, 23 are unclamped by retracting the first and second clamp rams 7, 11.

The first hydraulic ram 12 is then retracted to longitudinally displace the first clamp 2 relative to and away from the second clamp 3. Simultaneously, the second hydraulic ram 19 is extended, driving the carriage 20 and first and second clamps 2, 3 back along the cable 1 to the left. The apparatus is thus reset and ready to form a further bulbous portion spaced along from the first bulbous portion 25, clamping third and fourth portions of the cable spaced from the first and second cable portions 22, 23.

Advancing the cable in a forward direction by virtue of the second hydraulic ram 19 whilst forming the bulbous portion by virtue of the first hydraulic ram 12, and subsequently driving the carriage 20 and first and second clamps 2, 3 back along the cable whilst the first hydraulic ram 12 is reset in preparation for forming a further bulbous portion, enables increased production rates compared to prior processes.

It is envisaged that the apparatus may dispense with either of the first clamp rotation device and the second clamp displacement device if only the advantages of one or the other are desired.

Figure 3:
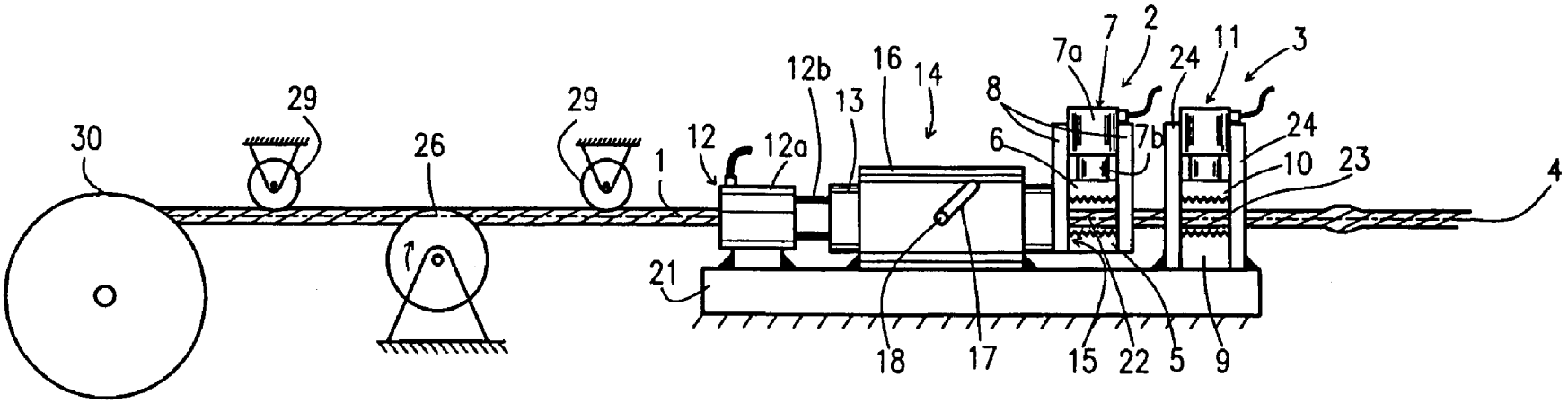
FIG. 3 is a side elevation view of an alternate apparatus for manufacturing a cable bolt.

An example of an apparatus for manufacturing a cable bolt that dispenses with the second clamp displacement device is depicted in FIG. 3. Features of the apparatus of FIG. 3 that are common with the apparatus of FIGS. 1 and 2 are provided with like numerals.

Figure 4:
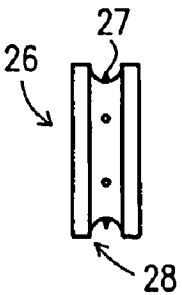
FIG. 4 is an end elevation view of the drive wheel of the apparatus of FIG. 3.

In the apparatus of FIG. 3, the first and second clamps 2, 3, first hydraulic ram 12 and cam mechanism 14 are all mounted directly on a fixed base 21, rather than on a slidable carriage as per the apparatus of FIGS. 1 and 2. Accordingly, the first and second clamps 2, 3 are not arranged to be simultaneously longitudinally displaced along the longitudinal axis 4 of the apparatus. As a result, the cable 1 is not advanced during the bulb formation process by simultaneous displacement of the first and second clamps 2, 3. Instead, with the apparatus of FIG. 3, the cable 1 is advanced along the longitudinal axis 4 by way of a drive wheel 26 that engages the cable 1 by way of radially protruding sprockets 27 mounted in an annular cable receiving recess 28 extending about the periphery of the drive wheel 26, as best depicted in FIG. 4. Two guide wheels 29 engage an opposing side of the cable upstream and downstream of the drive wheel 26 respectively so as to maintain the cable 1 in engagement with the pike-like sprockets 27 of the drive wheel 26. Rather than locating guide wheels 29 upstream and downstream of the drive wheel 26, it is envisaged that a single guide wheel might be utilised directly opposing the drive wheel 26.

The first and second clamps 2, 3, first hydraulic ram 12 and cam mechanism 14 act in the same manner as for the apparatus of FIGS. 1 and 2 to form a bulbous portion 25 in the cable 1. Upon completion of formation of a bulbous portion 25, the drive wheel 26 is activated to advance the cable 1 from a supply drum 30 a predetermined distance in preparation for forming a further bulbous portion spaced along from the first bulbous portion. The drive wheel 26 will typically be activated whilst the first hydraulic ram 12 is being retracted in preparation for forming the further bulbous portion. During the activation of the drive wheel 26 and retraction of the first hydraulic ram 12 the first and second clamp rams 7, 11 will be in the retracted position such that the cable is unclamped, allowing it to be advanced through the first and second clamps 2, 3 by the drive wheel 26.

The person skilled in the art will appreciate various modifications to the apparatus and method disclosed.

The invention claimed is:

1. An apparatus for manufacturing a cable bolt from a cable, said apparatus having a longitudinal axis and comprising: a first clamp adapted to releasably clamp the cable with the cable extending along said longitudinal axis through said first clamp; a second clamp adapted to releasably clamp the cable with the cable extending along said longitudinal axis through said second clamp; a first clamp displacement device for longitudinally displacing said first clamp, relative to said second clamp, along said longitudinal axis; and a first clamp rotation device for rotating said first clamp, relative to said second clamp, about said longitudinal axis; wherein said first clamp rotation device is adapted to rotate said first clamp relative to said second clamp simultaneously with longitudinal displacement of said first clamp relative to said second clamp.

2. The apparatus of claim 1 wherein said first clamp rotation device comprises a cam mechanism.

3. An apparatus for manufacturing a cable bolt from a cable, said apparatus having a longitudinal axis and comprising: a first clamp adapted to releasably clamp the cable with the cable extending along said longitudinal axis; a second clamp adapted to releasably clamp the cable with the cable extending along said longitudinal axis; a first clamp displacement device for longitudinally displacing said first clamp, relative to said second clamp, along said longitudinal axis; and a first clamp rotation device for rotating said first clamp, relative to said second clamp, about said longitudinal axis; wherein said first clamp rotation device is adapted to rotate said first clamp relative to said second clamp simultaneously with longitudinal displacement of said first clamp relative to said second clamp;

wherein said first clamp rotation device comprises a cam mechanism; and wherein said cam mechanism comprises: a first cylinder concentrically mounted with respect to said longitudinal axis and being rotationally fixed in relation to said first clamp, said first cylinder having an aperture extending longitudinally therethrough for receipt of the cable extending along said longitudinal axis, and a second cylinder concentrically mounted about said first cylinder, wherein one of said first and second cylinders is provided with a cam slot extending at an acute angle to said longitudinal axis, with the other of said first and second cylinders being provided with a cam follower engaging said cam slot.

4. The apparatus of claim 1 wherein said first clamp displacement device comprises a first hydraulic ram.

5. The apparatus of claim 1 further comprising a second clamp displacement device for simultaneously longitudinally displacing said first clamp and said second clamp along said longitudinal axis.

6. The apparatus of claim 5 further comprising a carriage, said first and second clamps being mounted on said carriage, with said second clamp displacement device being adapted to longitudinally displace said carriage along said longitudinal axis.

7. The apparatus of claim 6 wherein said first clamp displacement device and said first clamp rotation device are mounted on said carriage.

8. The apparatus of claim 7 wherein said second clamp displacement device comprises a second hydraulic ram.

9. The apparatus of claim 1 further comprising a drive wheel for engaging and advancing the cable along said longitudinal axis.

10. An apparatus for manufacturing a cable bolt from a cable, said apparatus having a longitudinal axis and comprising: a first clamp adapted to releasably clamp the cable with the cable extending along said longitudinal axis; a second clamp adapted to releasably clamp the cable with the cable extending along said longitudinal axis; a first clamp displacement device for longitudinally displacing said first clamp, relative to said second clamp, along said longitudinal axis; and a first clamp rotation device for rotating said first clamp, relative to said second clamp, about said longitudinal axis; wherein said first clamp rotation device is adapted to rotate said first clamp relative to said second clamp simultaneously with longitudinal displacement of said first clamp relative to said second clamp;

a drive wheel for engaging and advancing the cable along said longitudinal axis; and wherein said drive wheel is provided with radially extending spikes for engaging the cable.

11. A method for manufacturing a cable bolt from a cable, said method comprising the steps of: (a) clamping a first portion of said cable with a first clamp; (b) clamping a second portion of said cable with a second clamp, said second portion of said cable being spaced from said first portion of said cable along a longitudinal axis of said cable; (c) rotating said first clamp, relative to said second clamp, about said longitudinal axis in a direction against the lay of said cable; (d) longitudinally displacing said first clamp, relative to said second clamp, along said longitudinal axis towards said second clamp; and (e) unclamping said first and second portions of said cable; wherein steps (c) and (d) are carried out simultaneously.

12. The method of claim 11 further comprising the step of: (f) advancing said cable along said longitudinal axis.

13. The method of claim 12 wherein step (f) is carried out by simultaneously displacing said first and second clamps along said longitudinal axis in a forward direction, steps (f) and (d) being carried out simultaneously.

14. The method of claim 13 further comprising the step of: (g) simultaneously displacing said first and second clamps along said longitudinal axis in a reverse direction, wherein step (g) is carried out after step (e).

15. The method of claim 14 wherein steps (a) to (g) are repeated, clamping third and fourth portions of said cable, said third and fourth portions of said cable being longitudinally spaced from said first and second portions of said cable.

16. The method of claim 12 wherein step (f) is carried out by a drive wheel engaging said cable, step (f) being carried out after step (e).

* * * * *